US006394739B1

(12) United States Patent
Hutchinson

(10) Patent No.: US 6,394,739 B1
(45) Date of Patent: May 28, 2002

(54) APPARATUS FOR LIFTING AND TRANSPORTING STACKS OF STRAPPED BLOCKS

(76) Inventor: Charles E. Hutchinson, 208 Buckler Ct., Simpsonville, SC (US) 29681

( * ) Notice: Subject to any disclaimer, the term of this patent is extended or adjusted under 35 U.S.C. 154(b) by 0 days.

(21) Appl. No.: 09/802,030

(22) Filed: Mar. 8, 2001

(51) Int. Cl.[7] ..... B66C 1/30

(52) U.S. Cl. ..... 414/729; 414/621; 414/623; 294/88

(58) Field of Search ..... 414/729, 739, 414/620, 621, 623; 294/88, 81.51, 67.31, 63.1

(56) References Cited

U.S. PATENT DOCUMENTS

| | | | | | |
|---|---|---|---|---|---|
| 2,491,805 | A | * | 12/1949 | Fontaine | 214/65.2 |
| 2,509,023 | A | * | 5/1950 | Vogel et al. | 214/65.2 |
| 2,536,151 | A | | 1/1951 | Backofen et al. | 214/66 |
| 2,554,433 | A | | 5/1951 | Warren | 294/106 |
| 2,601,933 | A | * | 7/1952 | Seagraves et al. | 214/115 |
| 2,768,018 | A | | 10/1956 | Ehmann | 294/63 |
| 2,956,700 | A | * | 10/1960 | Quayle | 214/655 |
| 3,203,567 | A | * | 8/1965 | Huitfeldt | 214/652 |
| 3,971,585 | A | * | 7/1976 | LaBudde | 294/88 |
| 4,090,628 | A | * | 5/1978 | Sinclair | 214/655 |
| 4,215,622 | A | | 8/1980 | Chichester | 91/508 |
| 4,334,817 | A | * | 6/1982 | Vansickle et al. | 414/24.5 |
| 5,073,080 | A | | 12/1991 | Blum | 414/739 |
| 5,082,413 | A | | 1/1992 | Grosz et al. | 414/24.5 |
| 5,445,490 | A | | 8/1995 | Whitehead | 414/607 |

FOREIGN PATENT DOCUMENTS

| | | | |
|---|---|---|---|
| GB | 2221669 | A | * 2/1990 |

* cited by examiner

*Primary Examiner*—Eileen D. Lillis
*Assistant Examiner*—Michael Lowe
(74) *Attorney, Agent, or Firm*—McNair Law Firm, P.A.

(57) ABSTRACT

An attachment for use with a skid loader for lifting and transporting stacks of strapped blocks which includes a frame having an upper and lower horizontal bar, a pair of arms pivotally mounted with the upper bar which are in sliding engagement with the lower bar. A drive member is carried by the frame between the arms for moving the arms between a disengaged and an engaged position. A foot assembly which includes first and second legs and a grabber foot is connected with each of the arms. Each grabber foot includes a planar inner face and is pivotally mounted with a second leg to extend substantially perpendicularly of the associated arm with its inner face canting slightly upwardly and outwardly.

17 Claims, 4 Drawing Sheets

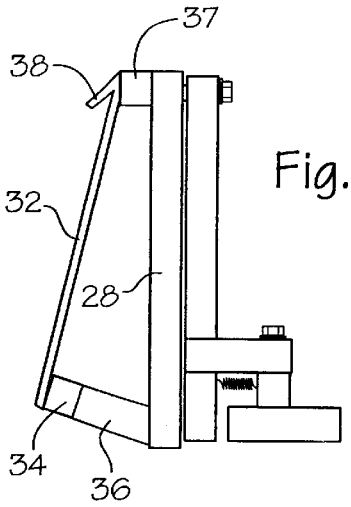
Fig. 5
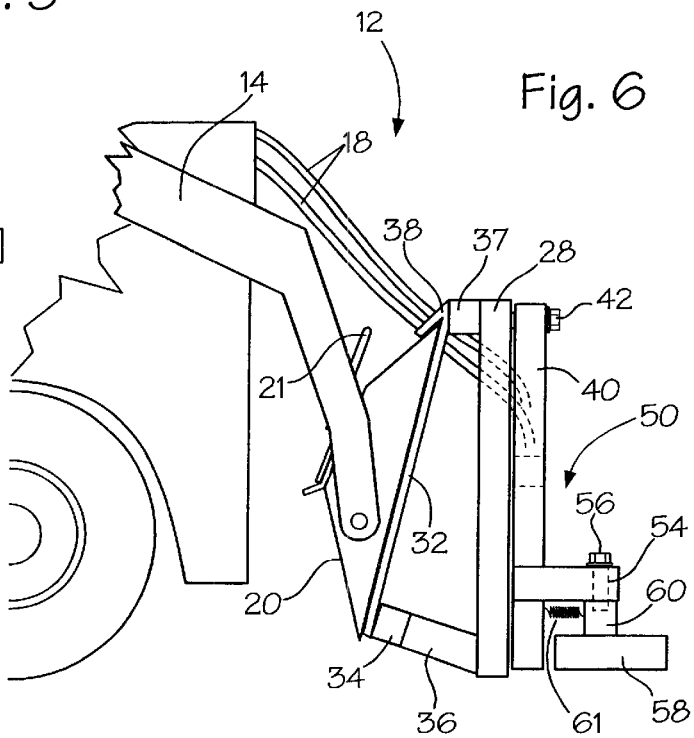
Fig. 6
Fig. 7
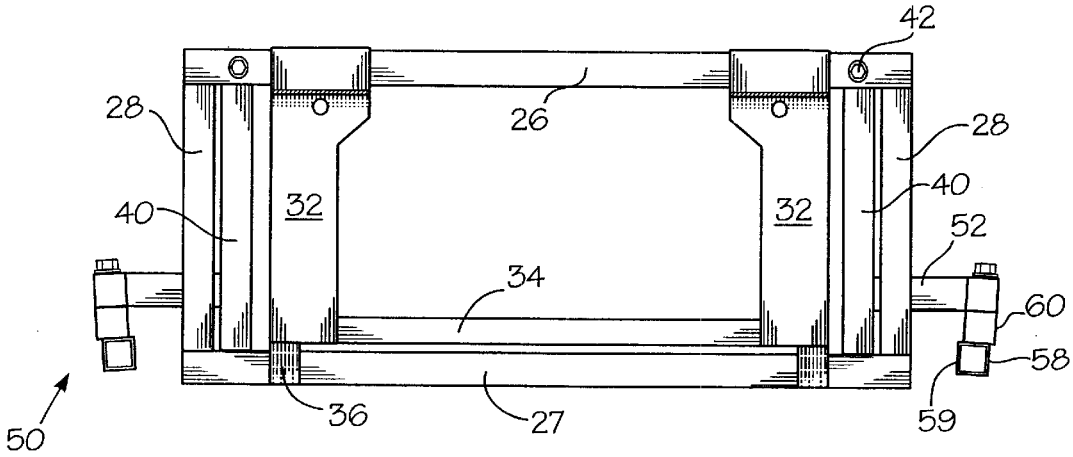

APPARATUS FOR LIFTING AND TRANSPORTING STACKS OF STRAPPED BLOCKS

BACKGROUND OF THE INVENTION

The invention is directed to an attachment for use with a loader, preferably a skid loader such as a BOBCAT, which is operative to grasp or grab a strapped stack of block and move it between locations. The term block is intended as a generic term which covers brick, concrete block, cut granite blocks and other similar type of stackable building materials.

There are several known block pick-up apparatus now in use such as those illustrated by U.S. Pat. Nos. 4,215,622; 2,554,433; 2,491,805; and, 2,768,018. These devices are designed to operate with tractors, with lift trucks and with horizontal beams. None are designed as quick engagement and release devices which are operated with a skid loader.

Small contractors generally operate with a minimum of equipment due to cost. A piece of equipment established as being capable of performing a multitude of operations and being fairly inexpensive is the skid loader. The reason for this flexibility is that there are a multitude of attachment devices which operate with skid loaders to perform different and varied functions. An important attraction for providing these various attachments is that skid loaders are provided with mounting units at the end of the lift arms which are capable of easy attachment with and detachment from the various attachment devices.

Accordingly, an object of the instant invention is the provision of a block grabber and lift apparatus for on site lifting and movement of strapped stacks of block.

Another object of the invention is an apparatus which is easy to attach with and detach from a loader.

Another object of the invention is an attachment apparatus capable of lifting strapped stacks of block without the stack falling apart.

Another object of the invention is the provision of an inexpensive block lifting and moving apparatus.

Another object of the invention is a block lifting and moving apparatus which is capable of grabbing and lifting a strapped stack of blocks without engaging the bottom of the stack.

SUMMARY OF THE INVENTION

The invention is directed to an apparatus which operates as an attachment for a loader and it has as its primary object lifting and transporting strapped stacks of blocks. The apparatus includes a frame having a horizontal bar. A mounting assembly for releasably engaging the apparatus with a loader is secured with a first side of the horizontal bar. A grabber assembly which engages and secures the strapped blocks with the apparatus comprises downwardly depending first and second arms which are pivotally mounted with the horizontal bar. The first and second arms each extend along a longitudinal axis. A piston assembly is mounted between and is engaged with each of the first and second arms. The piston assembly is operative to pivot the first and second arms between an outwardly disengaged position and an inwardly engaged position.

A foot assembly is located adjacent and forward of the lower ends of the first and second arms. Each foot assembly includes a pivotally mounted grabber foot which is disposed transversely of the longitudinal axis of each of the first and second arms.

In operation, the apparatus is mounted to a loader with its hydraulic system attached. The arms are moved to the disengaged position allowing the apparatus to be moved into a position adjacent a stack of strapped blocks. In this position, the foot assembly is located outwardly of opposed sides of the stack of strapped blocks. The loader is controlled to now move the arms of the apparatus into the engaged position where the grabber feet engage with the opposed sides of the stack of strapped blocks. The loader is now manipulated to raise the apparatus along with the engaged stack of strapped blocks. The loader can now be moved into a spaced position where the stack of strapped blocks may be deposited.

The frame includes a second horizontal bar located below the horizontal bar. This bar along with a guide arm acts as a stabilizer for the lower ends of said first and second arms when in the raised position.

The foot assembly includes an L-shaped extension with a first leg secured with and extending from outer sides of each of the first and second arms and with a second leg forming a right angle with the first leg. The second legs mount the grabber foot.

A bore extends through each second leg and a rod is rotably carried in the bore. The grabber feet are carried by the rods. Each rod extends through the second leg inwardly at a slight angle with respect to the second leg so that the grabber feet are arranged along one of an obtuse or acute angle and are canted toward each other.

The mounting assembly includes a coupling plate which is secured with the cross bar at its upper end to extend downwardly. A lip is secured with the upper end of the coupling plate so that both the lip and the coupling plate function to releasably engage the assembly with a mounting unit of the loader. Preferably, there are a pair of spaced plates forming the coupling mounting assembly with each plate being connected at its lower end with a tire rod.

The grabber assembly includes an L-shaped extension having first and second legs connected with each arm. The second leg pivotally mounts the grabber foot in a position substantially transverse of the longitudinal direction of the first and second arms. Each grabber foot is preferably constructed of a length of 2" square piping having a planar inner face which is disposed outwardly along a slight angle toward its upper edge. Each arm is also formed of 2" square piping.

An attachment for a skid loader for lifting and transporting stacks of strapped blocks comprises a frame having an upper and lower horizontal bar. A pair of arms are pivotally mounted in spaced positions with the upper bar and are in sliding engagement with the lower bar. A drive member is carried by the frame between the arms and acts to move the arms between disengaged, or expanded, and engaged, or contracted, positions. A foot assembly, which includes first and second legs and a grabber foot, is connected with each arm adjacent its lower end. Each grabber foot is formed with a planar inner face and is pivotally mounted with the second leg to extend in a position which is substantially perpendicular of a horizontal axis passing through the respective of the arms. The inner faces of the grabber feet are positioned to cant slightly outward from a bottom edge.

In operation, the attachment is positioned adjacent a strapped stack of blocks, the arms are moved from a disengaged position inward to an engaged position where the faces of the grabber feet engage opposed sides of strapped stack of blocks and are moved to substantially vertical positions causing the second arms to torque.

The coupling plates and the downwardly directed lips are operative to engage with a mounting unit of a skid loader which connects the attachment with the loader in a manner which is secure but is also easily released.

DESCRIPTION OF THE DRAWINGS

The invention will be more readily understood from a reading of the following specification and by reference to the accompanying drawings forming a part thereof, wherein an example of the invention is shown and wherein:

FIG. 5 is a side view of the apparatus;

FIG. 6 is similar to FIG. 5 but includes the mounting unit of the loader engaged with the mounting assembly;

FIG. 7 is a front view of the apparatus with the hydraulic cylinder and associated equipment omitted;

DESCRIPTION OF A PREFERRED EMBODIMENT

Figure 1:
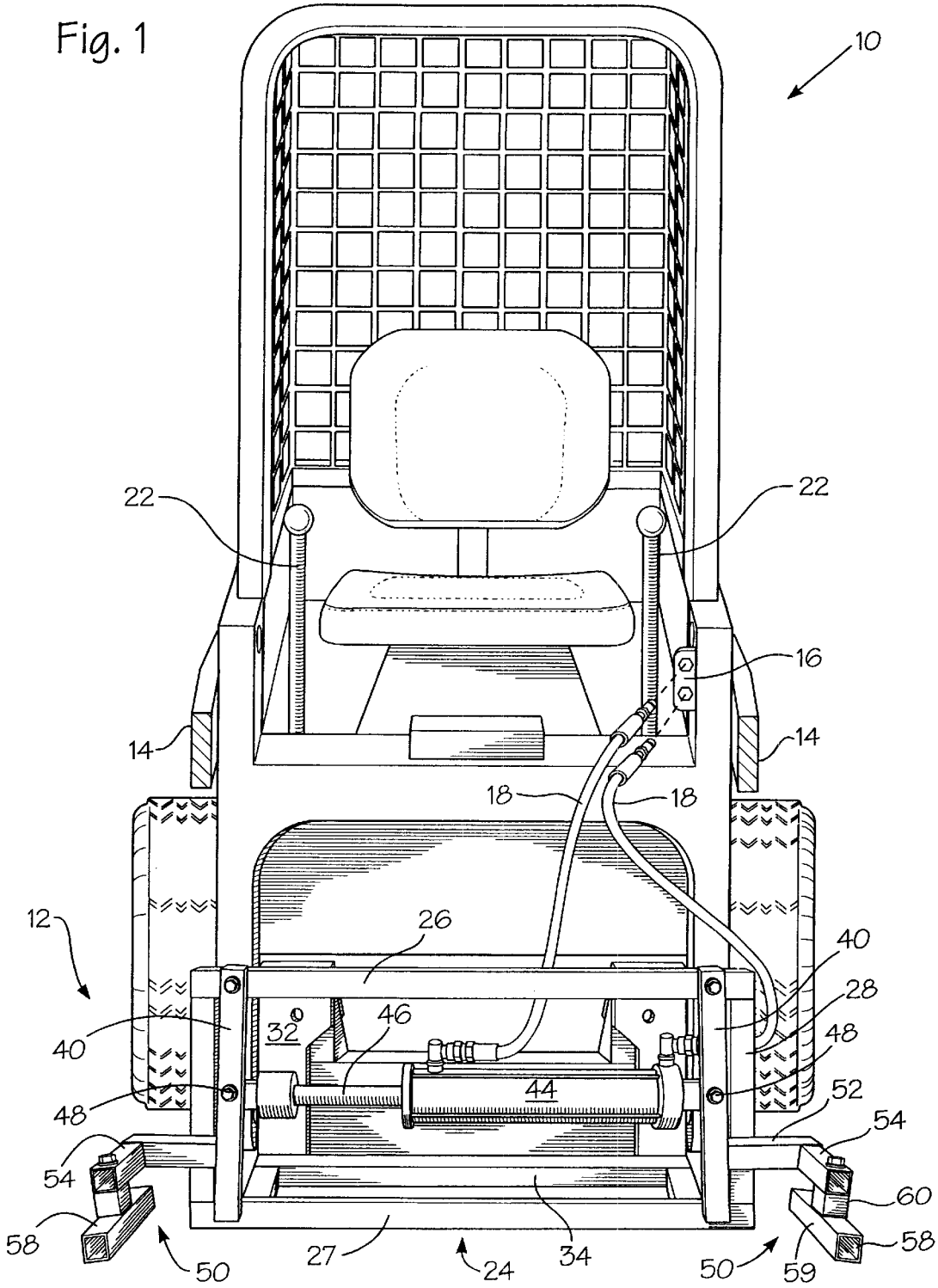
FIG. 1 is a front view of the grab and lift apparatus attached with a skid loader.

Turning now to the drawings, FIGS. 1, 5, and 6 show a typical skid loader, such as a BOBCAT, to which the grab and lift apparatus 12 of the invention has been mounted. The loader includes the usual structure associated with these types of machinery such as lift arms 14, a disconnect 16 for attaching with hydraulic lines 18 of the grab and lift apparatus and the other usual attachments designed for use with skid loaders. Arms 14, at their forward ends, carry the usual mounting unit 20, best seen in FIG. 6, which secures with the instant attachment as well as other attachment units which are designed to operate with a skid loader. Control levers 22, along with the other usual controls, operate the skid loader, its lift arms 14, and mounting unit 20 in the usual manner.

Grab and lift apparatus 12, as shown in FIGS. 1, 2, 5, and 7, consist of a substantially rectangular frame 24 which includes horizontal upper bar 26 connected with vertical bars 28. Vertical bars 28, at their lower ends, connect with horizontal lower bar 27 forming frame 24 to be substantially rectangular.

Mounted with the rear side of upper and lower bars 26, 27 is mounting assembly which includes a coupling plate comprised of a pair of plates 32 secured at upper ends with upper bar 26 and at lower ends with mounting arm 34. Spacers 36 extend rearwardly from lower bar 27 to position arm 34 sufficiently away from lower bar 27 for plates 32 to extend along an obtuse angle relative the axis of vertical bars 28. Preferably the upper end of plates 32 are separated from upper bar 26 by a spacer 37 to allow sufficient separation between plates 32 and upper and lower bars 26, 27 to mount a piston cylinder unit, to be described later, with lift apparatus 12.

Plates 32 include a downwardly directed lip 38 which engages over the upper end of mounting unit 20 when engaged with grip and lift apparatus 12. Lever 21, of mounting unit 20, releasably engages the mounting unit with apparatus 12.

The mounting unit 20 which is best shown in FIGS. 6, 8, 9, and 10 is standard equipment for skid loaders and forms no part of the instant invention.

Turning again to FIGS. 1, 2, 5, and 7, arms 40 are pivotally mounted at their upper ends to upper bar 26, adjacent its opposed ends, by bolts 42. Bolts 42 are arranged along a generally horizontal plane generally parallel the plane along which upper bar 26 extends. Arms 40 depend downwardly a distance which allows their lower ends to be substantially parallel with lower bar 27. Lower bar 27 prevents the lower ends of arms 40 from being urged rearwardly when the unit is engaged with a stack of blocks. Lower bar 27 essentially serves guide for arms 40.

Mounted at an intermediate point of arms 40 is a hydraulic cylinder 44 which mounts piston 46. Piston/cylinder 44, 46 is pivotally mounted by bolts 48 to and between arms 40. Hydraulic lines 18 connect cylinder 44 with the hydraulic system of loader 10 by way of disconnect 16. Preferably cylinder 44 has a 2" bore and a 10" stroke.

Mounted just below the pivotal connection between arms 40 and piston/cylinder 44, 46 is the foot assembly 50. This assembly includes an L-shaped extension having a first leg 52 connected with the outer side of arms 40 just below bolt 48. Each leg 52 is substantially perpendicular of the axis of a respective of arms 40. Mounted to the end of each leg 52 and extending forwardly away from arm 40 is leg 54. A substantially vertical bore 55 is provided adjacent the end of leg 54 and pivotally receives rod 56. Mounted to the lower end of rod 56 is grabber foot 58. Grabber foot 58 includes an upper shoulder 60 to which is attached a spring 61. The opposite end of springs 61 are attached with either leg 52 or arm 40 and are functional to maintain grabber feet 58 extending substantially transverse of arms 40. Also, it is noted that bores 55 extend at a slight inwardly directed angle with respect to the longitudinal axis of arms 40. This provides that bolts 50 each extend at one of an acute or an obtuse angle as do the faces 59 of grabber feet 58.

Figure 2:
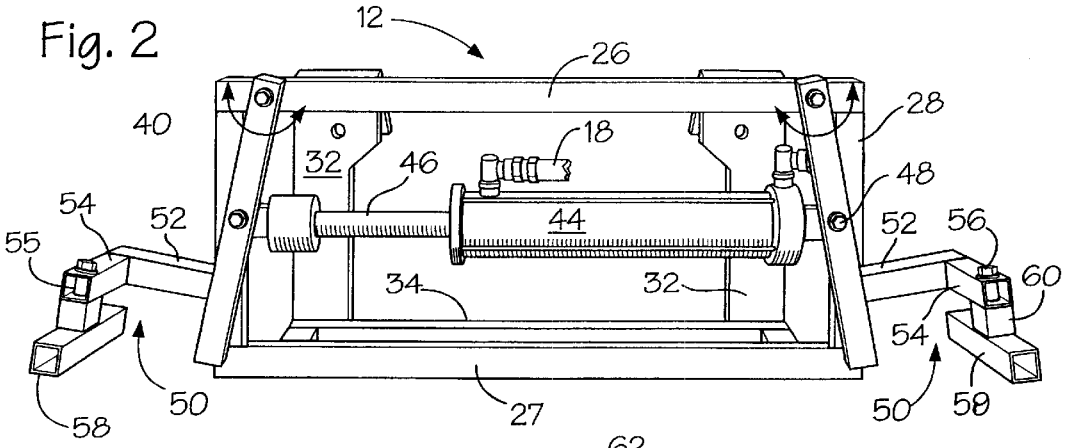
FIG. 2 is a front view of the device with its arms in the extended position.
Figure 3:
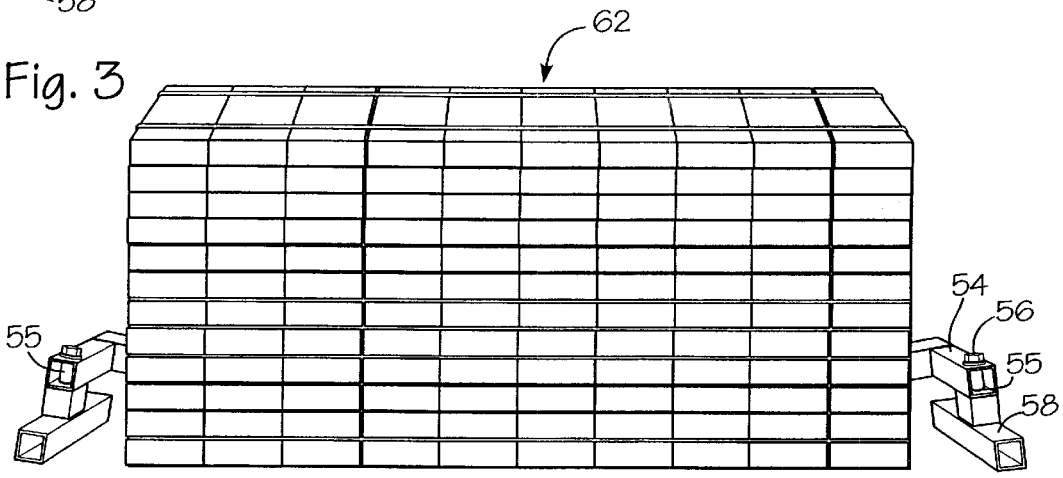
FIG. 3 is a front view of the foot assembly in separated positions adjacent opposed sides of a strapped stack of blocks.
Figure 4:
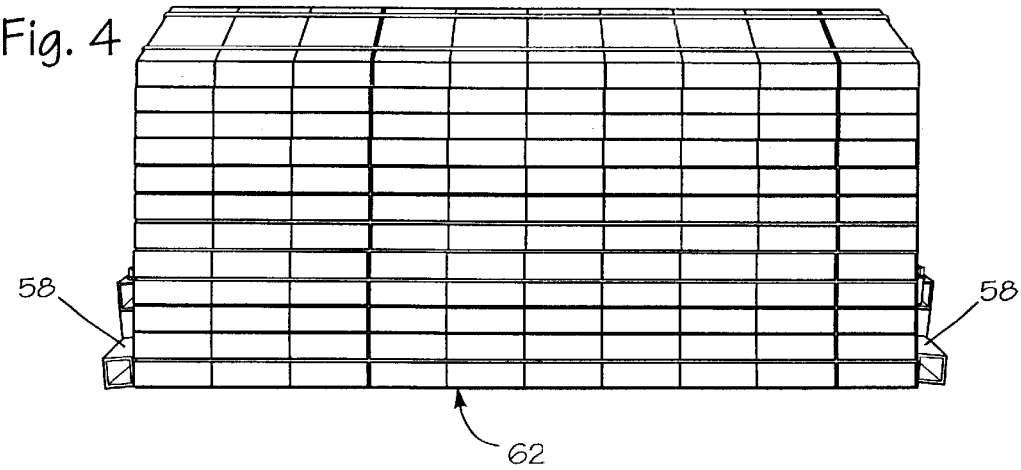
FIG. 4 is similar to FIG. 3 with the foot assembly in the engaged position.
Figure 8:
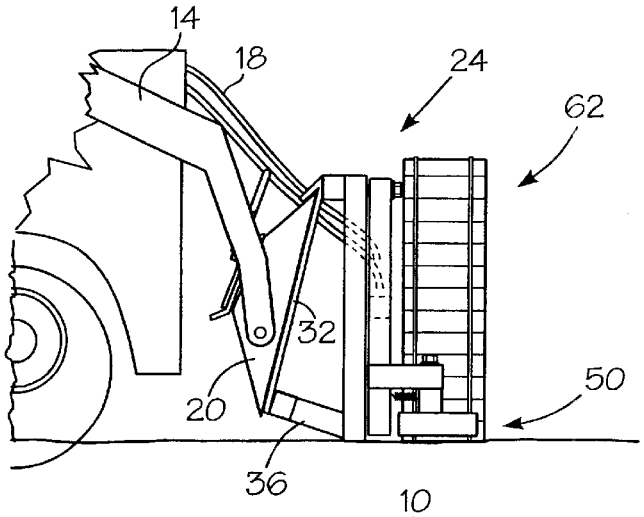
FIG. 8 is a side view of the apparatus engaged with the grab apparatus and with the grab apparatus engaged with a strapped stack of blocks.

In operation the gripping and lift apparatus 12 is connected with a loader as shown in FIGS. 1, 8, 9, and 10. The piston/cylinder 44, 46 is actuated to move arms 40 to the outwardly extending disengaged positions as shown in FIGS. 2 and 3. The loader is maneuvered to position the grab and lift apparatus relative to a strapped stack of blocks 62 as shown in FIGS. 3 and 8. It is noted that it is not necessary for some type of plate or lift arm to be positioned beneath the stack of blocks. In some cases positioning such members creates problems with getting the lift and grab apparatus positioned. Once apparatus 12 is in position, arms 40 are actuated by cylinder/piston 44, 46 to bring arms 40 into the engaged position as shown in FIGS. 1, 4, and 7. Inner faces 59 of grabber feet 58 are brought into contact with opposite sides of stack 62. As arms 40 are brought into their final positions leg 54 are caused to slightly torque as faces 59, which are engaged with the sides of the stack, are brought into substantially vertical positions. This action provides a resilient engagement between grabber feed 58 and the sides of stack 62.

Figure 9:
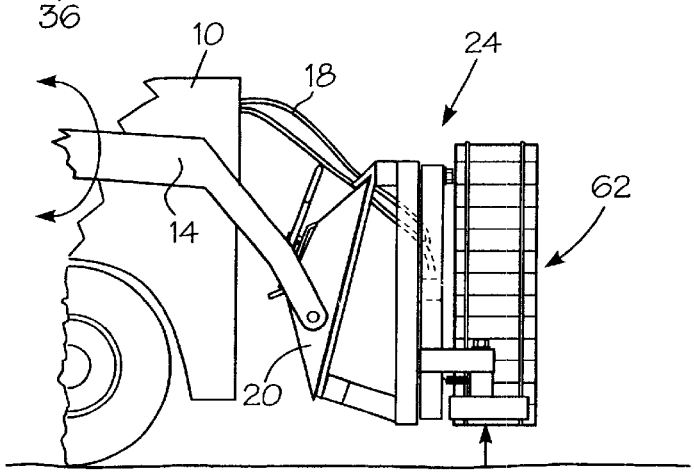
FIG. 9 is similar to FIG. 8 showing the block slightly elevated.
Figure 10:
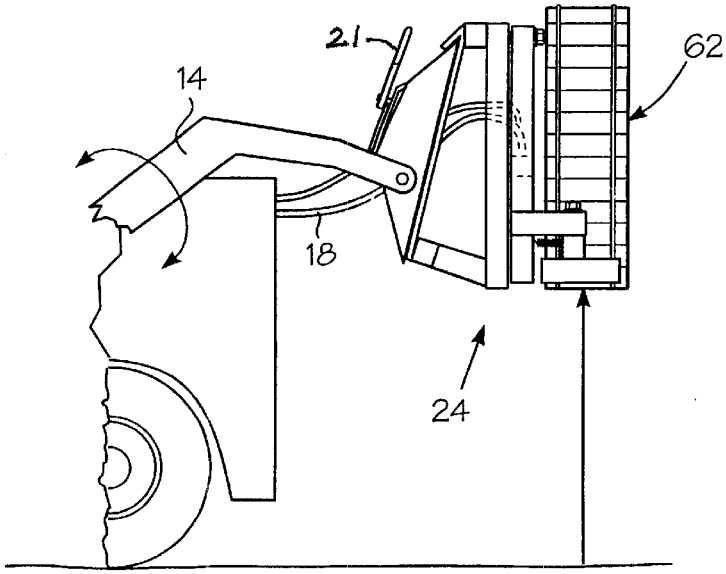
FIG. 10 is similar to FIGS. 8 and 9 showing the block elevated to a higher position.

Lift arms 14 may now be actuated to lift stack 62 upward from its support surface as shown in FIGS. 9 and 10. It is noted that the lift mechanism of loader 10 maintains mounting unit 20 at a constant angle during lifting which maintains stack 62 in a substantially vertical position at all times.

When the strapped stack of blocks is elevated into a desired position, loader 10 moves to a distant location where the stack of blocks is deposited. Any desired location, the ground, a truck bed, or a work platform are normal areas of deposit.

Preferably, the bars and rods forming the apparatus are steel, 2" square, ¼" thick stock. Naturally other materials and sizes may be used if found to be desirable.

While a preferred embodiment of the invention has been described using specific terms, such description is for illustrative purposes only, and it is to be understood that changes and variations may be made without departing from the spirit or scope of the following claims.

What is claimed is:

1. Apparatus, which is operative with a loader, for lifting and transporting stacks of strapped blocks comprising:

a frame having a horizontally extending upper bar;

a mounting assembly, adapted to be releasably engaged with said loader, secured with a first side of said upper bar;

a grabber assembly, for engaging and securing said strapped blocks with said apparatus, including downwardly depending first and second arms pivotally mounted about generally horizontal axes with said upper bar, said first and second arms each having a longitudinally extending axis;

a piston assembly arranged between and engaged with each of said first and second arms, said piston assembly being operative to pivot said first and second arms about said generally horizontal axes between an outwardly disengaged position and an inwardly engaged position;

a foot assembly located generally forward of lower ends and in opposed outward positions of said first and second arms, each said foot assembly including a pivotally mounted grabber foot disposed transverse of the longitudinal axis of each respective first and second arm; whereby, said apparatus, with said arms moved to said disengaged position, may be moved into position adjacent a stack of strapped blocks with said foot assemblies located outwardly of opposed sides of said stack of strapped blocks, said arms may then be moved into said engaged position engaging said grabber feet with said opposed sides of said stack of strapped blocks, said apparatus may then be raised lifting said stack of strapped blocks, said apparatus may then be moved into a spaced position where said stack of strapped blocks may be deposited.

2. The apparatus of claim 1 wherein said frame includes a second horizontally extending lower bar located below said upper bar, said lower bar acting as a stabilizer for said lower ends of said first and second arms.

3. The apparatus of claim 1 wherein each of said foot assemblies include an L-shaped extension with a first leg thereof secured with and extending from an outer side of a respective of said first and second arms and with a second leg, of each said L-shaped extension, forming a right angle with said first leg, said second leg mounting said grabber foot.

4. The apparatus of claim 3 including a bore through each said second leg, a rod rotably carried in said bore, said grabber feet being carried by said rods.

5. The apparatus of claim 4 wherein said rods extend inwardly from the axis along which said second leg extends at a slight angle.

6. The apparatus of claim 3 wherein each said grabber foot includes an inner face lying along one of an acute or obtuse angle canting each said grabber foot inwardly toward the other of said grabber feet, said inner faces engaging said opposite sides of said stack of strapped blocks and causing the second legs to torque slightly outward when said arms are moved into said engaged position.

7. The apparatus of claim 1 wherein each said grabber foot is arranged along one of an obtuse or acute angle to be canting toward each other.

8. The apparatus of claim 1 wherein said mounting assembly includes a downwardly extending coupling plate secured at its upper end with said upper bar, a lip secured with said upper end of said coupling plate, said lip and said coupling plate being adapted to releasably engage with a mounting unit of said loader.

9. The apparatus of claim 8 wherein said coupling plate comprises a pair of spaced plates connected at lower ends with a mounting arm.

10. The apparatus of claim 1 wherein each said grabber assembly includes an L-shaped extension having a first and a second leg, said second leg pivotally mounting said grabber foot in a substantially transverse relationship with a respective of said first and second arms.

11. The apparatus of claim 10 wherein each said grabber foot comprises a length of 2" square piping having a planar inner face disposed outwardly at a slight angle.

12. The apparatus of claim 1 wherein each said grabber foot and said first and second arms are formed of 2" square piping.

13. The apparatus of claim 1 wherein said piston assembly comprises a single piston having a 2" bore and a 10" stroke.

14. An attachment for a skid loader for lifting and transporting stacks of strapped blocks comprising:

a frame having an upper and lower bar;

said frame including a pair of arms pivotally mounted with said upper bar and supported in sliding engagement with said lower bar;

a drive member carried by said frame between said pivotally mounted arms for moving said pivotally mounted arms between disengaged and engaged positions;

a foot assembly including first and second legs and a grabber foot connected in opposed positions with each said arm above its lower end outwardly and forward, its longitudinal axis;

each said grabber foot having a planar inner face and being pivotally mounted with said second leg to extend substantially perpendicular of said longitudinal axis of the associated of said pivotally mounted arms with said inner face canting slightly upwardly and outwardly; whereby, when said attachment is positioned adjacent a strapped stack of blocks with said pivotally mounted arms in said disengaged position, said pivotally mounted arms are moved inward to said engaged position where said faces of said grabber feet engage opposed sides of said strapped stack of blocks and are moved to substantially vertical positions causing said second legs to torque.

15. The attachment of claim 14 including spaced coupling plates with downwardly directed lips secured with said upper and lower bars, said coupling plates being operative to engage with a mounting unit of a skid loader which connects said attachment with said loader.

16. The attachment of claim 15 wherein said coupling plates are connected with said upper and lower bars through upper and lower spacers, said lower spacers positioning said coupling plates a greater distance from said lower bar than does said upper spacer.

17. The attachment of claim 14 wherein said drive member comprises a hydraulic piston with hydraulic lines each of said hydraulic lines including an adapter which connects with a hydraulic systems of said skid loader; whereby, said skid loader powers said arms between said disengaged and engaged positions.

* * * * *